US011035244B2

(12) United States Patent
Morliere et al.

(10) Patent No.: US 11,035,244 B2
(45) Date of Patent: Jun. 15, 2021

(54) AIRCRAFT TURBINE ENGINE SEALING MODULE

(71) Applicant: SAFRAN AIRCRAFT ENGINES, Paris (FR)

(72) Inventors: Simon Nicolas Morliere, Moissy-Cramayel (FR); Nicolas Jean-Marc Marcel Beauquin, Moissy-Cramayel (FR); Renaud James Martet, Moissy-Cramayel (FR); Vincent Francois Georges Millier, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 57 days.

(21) Appl. No.: 16/459,406

(22) Filed: Jul. 1, 2019

(65) Prior Publication Data

US 2020/0011194 A1 Jan. 9, 2020

(30) Foreign Application Priority Data

Jul. 3, 2018 (FR) ..... 1856139

(51) Int. Cl.
*F01D 11/12* (2006.01)
*F01D 11/00* (2006.01)
*F01D 25/24* (2006.01)

(52) U.S. Cl.
CPC ..... *F01D 11/122* (2013.01); *F01D 11/005* (2013.01); *F01D 25/246* (2013.01); (Continued)

(58) Field of Classification Search
CPC ..... F01D 11/005; F01D 11/08; F01D 11/122; F01D 25/243; F01D 25/246; F05D 2240/11; F05D 2240/55
See application file for complete search history.

(56) References Cited

U.S. PATENT DOCUMENTS 5,971,703 A * 10/1999 Bouchard ..... F01D 25/246 415/135
6,966,752 B2 * 11/2005 Gieg ..... F01D 11/127 415/173.4

(Continued)

FOREIGN PATENT DOCUMENTS

| | | |
|---|---|---|
| EP | 1840339 | 10/2007 |
| FR | 3058756 | 11/2016 |
| WO | WO 2013156734 | 10/2013 |

OTHER PUBLICATIONS

French Search Report dated Mar. 1, 2019 for French Application No. 1856139.

*Primary Examiner* — Brian P Wolcott
(74) *Attorney, Agent, or Firm* — Womble Bond Dickinson (US) LLP

(57) ABSTRACT

Turbine engine turbine sealing module extending about an axis and including a distributor fixed to a casing, and at least one blade connected to an outer platform. The turbine module further includes an impeller mounted rotating inside the casing and surrounded by a sealing ring fastened to this casing. The sealing ring includes an annular row of ring sectors arranged such that the circumferential end edges of two adjacent sectors are facing one another. Each sector includes a body configured to engage with at least one seal lip carried by the impeller and a hook which extends circumferentially which is configured to engage with a fastening rail of the casing. Each ring sector further includes a deflector which extends radially inwards and upstream with respect to the axis, such that the radially inward end thereof extends around a downstream end of the outer platform of the distributor.

7 Claims, 3 Drawing Sheets

(52) U.S. Cl.
CPC .... *F05D 2220/323* (2013.01); *F05D 2240/11* (2013.01); *F05D 2240/55* (2013.01)

(56) References Cited

U.S. PATENT DOCUMENTS

| | | | | |
|---|---|---|---|---|
| 8,206,092 | B2 * | 6/2012 | Tholen | F01D 11/08 415/173.1 |
| 8,240,985 | B2 * | 8/2012 | Martin | F01D 11/005 415/173.1 |
| 9,115,596 | B2 * | 8/2015 | Clouse | F01D 11/125 |
| 9,506,367 | B2 * | 11/2016 | Clouse | F01D 25/246 |
| 9,512,734 | B2 * | 12/2016 | Feldmann | F01D 11/001 |
| 9,803,491 | B2 * | 10/2017 | Clouse | F01D 11/005 |
| 9,957,841 | B2 * | 5/2018 | Gendraud | F01D 9/04 |
| 10,662,794 | B2 * | 5/2020 | Das | F01D 11/001 |
| 2014/0186163 | A1 | 7/2014 | Clouse et al. | |

* cited by examiner

AIRCRAFT TURBINE ENGINE SEALING MODULE

TECHNICAL FIELD

The present invention relates to a turbine engine module, which can be a turbine or form part of a turbine, for example.

STATE OF THE ART

The state of the art comprises, in particular, documents FR-A1-3 914 350 and WO-A1-2016/024060.

A turbine engine turbine comprises one or more stages, each comprising a distributor formed of an annular row of fixed blades carried by a casing of the turbine, and an impeller mounted rotating in general downstream of the distributor. The impeller is surrounded by a sealing ring which is sectored and formed by sectors which are arranged circumferentially end-to-end and which are fastened onto the casing of the turbine.

Each ring sector generally comprises a circumferentially-oriented body which has an abradable coating fixed on the inner surface of the body. This coating is, for example, of the honeycomb type and is intended to be used by friction on outer seal lips of the blades of the impeller, to form a labyrinth seal and minimise the radial clearances between the impeller and the ring sectors.

Each ring sector comprises, at the upstream and downstream ends thereof, fastening means on the casing. Each ring sector can comprise, at the downstream end thereof, a circumferential hook which defines an annular groove, wherein is engaged, on the one hand, an annular rail of the casing, and on the other hand, a fastening spoiler downstream of the distributor located upstream. The hook of the ring has, in the cross-section, a general U- or C-shape and comprises two coaxial circumferential walls, respectively inner and outer, connected together by a median bottom wall. The fastening spoiler, downstream of the distributor has a circumferential orientation and is held clamped radially against the casing rail by way of the circumferential hook upstream of the ring, of which the circumferential walls extend respectively inside the spoiler of the distributor and outside of the casing rail. This makes it possible to contribute to the radial holding of the distributor opposite the casing.

It is known to use an annular foil for protecting the casing rail, in particular against wear and high temperatures. This foil can be sectored and thus comprises an annular row of foil sectors arranged circumferentially end-to-end. It has, in the cross-section, a general U- or C-shape and comprises two coaxial circumferential walls, respectively inner and outer, connected together by a median bottom wall.

The foil sectors are made of sheet metal and make it possible to avoid the direct contacts between the hooks of the ring sectors and the casing rail, which makes it possible, on the one hand, to protect the latter against wear by friction and on the other hand, to protect it thermally from the ring which can be very hot while functioning due to the proximity thereof with combustion gases flowing into the turbine duct.

Due to the sectorisation of the ring, the longitudinal edges of the circumferential ends of two adjacent sectors of the ring are facing one another and are separated from one another by a circumferential clearance through which hot gases of the duct can pass. These hot gases tend to heat the casing, which is damaging for several reasons. One of the reasons, is that a heating of the casing would lead to a dilatation and a deformation of the latter which would risk altering the radial clearances between the mobile impeller and the ring, and therefore decrease the performance of the turbine. Moreover, these gas leaks have an impact on the performance of the turbine engine. For these two reasons, it is necessary to seal, as much as possible, the inter-sector zones. A known solution to this problem consists of inserting seal lips between the ring sectors, which are housed in the slots of the abovementioned longitudinal edges of the ring sectors.

However, due to the sectorisation of the foil, the longitudinal edges of the circumferential ends of two adjacent sectors of the foil are facing one another and are separated from one another by a circumferential clearance. In the current technique, the circumferential clearances between the foil sectors can be offset circumferentially with respect to the circumferential clearances between the ring sectors, and in particular, with respect to the circumferential clearances between the hooks of the ring sectors at the level of which it is not possible to mount seal lips of the abovementioned type for size reasons, in particular. Hot gases can thus pass through circumferential clearances between the hooks of the ring sectors and impact the foil sectors, which will heat by conduction, the casing rail, and therefore risks reducing the lifespan thereof.

Document WO-A1-2016/024060 proposes to circumferentially offset each foil with respect to the associated hook so as to best protect the casing rail as the gases which would be likely to pass between the edges of the circumferential ends of the ring sectors are blocked by the foil sectors (due to the circumferential offset thereof opposite the ring sectors) and do not reach to the casing rail. However, this solution does not make it possible to protect the casing from inter-sector leaks which occur at the level of the median bottom walls of the hooks of the ring.

Document FR-A1-3 914 350 proposes to circumferentially offset the body of the ring sector, with respect to the hook thereof and to the abradable coating thereof. However, this solution is only applicable in the case where the body of the ring sector covers the hook thereof, which is not always the case when an optimisation of the integration is desired. This solution furthermore leads to inter-sector leaks at the level of the hooks of the ring sectors.

Moreover, the gases of the duct which are likely to heat and damage the casing leak out of the duct by passing through an axial clearance between the outer periphery of the impeller and the outer periphery of the distributor located upstream of the impeller. These gases pass through this clearance by passing radially inside, outwards, and enter into a delimited annular space, upstream, through the fastening spoiler downstream of the distributor, and downstream, through a seal lip upstream of the impeller. This annular space is therefore the leak gas circulation place, which is likely to pass through the inter-sector clearances and reach the casing.

The present invention, in particular relates to providing a simple, effective and economic solution to this need by improving, in particular, the thermal protection of the casing rail in the case above.

SUMMARY OF THE INVENTION

The present invention thus proposes a turbine engine sealing module, in particular for aircraft, this sealing module extending about an axis and comprising a distributor fixed to a casing and comprising at least one blade connected to an outer platform, the outer platform comprising a spoiler fixed to the casing, the turbine casing further comprising a impeller mounted rotating inside the casing and surrounded by a sealing ring fastened to this casing, this ring being sectored and comprising an annular row of ring sectors arranged such that the circumferential end edges of two adjacent sectors are facing one another, each ring sector comprising a body carrying an abradable coating configured to engage with at least one seal lip carried by the impeller and a hook which extends circumferentially by being located upstream of said abradable coating and which is configured to engage with a fastening rail of the casing, this hook having, in the cross-section, a general C-shape of which the opening is oriented axially upstream and intended to receive said rail. The invention is characterised in that each ring sector further comprises a deflector which is arranged downstream of said coating and which extends radially inwards and upstream with respect to the axis such that the radially inner end thereof extends around a downstream end of the outer platform of the distributor. The invention is also characterised in that each hook has a circumferential extent identical to that of said deflector, and the circumferential ends of said hook are offset in the circumferential direction of the circumferential ends of said deflector.

The deflector is thus intended to be located in the above-mentioned annular space, between the outer periphery of the impeller and that of the distributor located upstream, and makes it possible to limit the gas circulations in this space. It makes it possible, in particular, to limit the circulation of leak gases at the level of the hook upstream of each ring sector and therefore to reduce the risk of these gases passing into the inter-sector clearances at the level of the hooks thereof. The casing is thus best protected and has an optimised lifespan.

The ends offset is also advantageous as the gases which are likely to pass radially inside, outwards through the circumferential clearances between the circumferential ends of the deflectors, are blocked by the hooks which extend facing these clearances, and the gases which are likely to pass radially inside, outwards through the circumferential clearances between the circumferential ends of the hooks, are blocked by the deflector sectors which extend facing these clearances.

The module according to the invention can comprise one or more of the following characteristics, taken individually or in combination with one another.

- said deflector comprises an annular sheet metal sector inserted axially between the hook, on the one hand, and the coating and/or body, on the other hand,
- the sheet metal sector has, in the cross-section, a general V-shape, of which a radially outer portion extends radially, and of which a radially inner portion is truncated and extends, upstream to downstream, radially inwards,
- the hook comprises a median bottom wall which connects two circumferential walls respectively radially inner and outer, the radially outer portion of the sheet metal sector inserted axially between the bottom wall of the hook, and the coating and/or the body,
- each deflector has a circumferential extent identical to that of said body and of said coating, and the circumferential ends of said deflector are substantially axially aligned with those of said body and of said coating,
- said body comprises, at the circumferential ends thereof of the slots for housing inter-sector seal lips, and said deflector comprises, at the circumferential ends thereof of the notches axially aligned with these slots such that the upstream axial ends of at least some of said seal lips enter into these notches; the seal lips thus extend the closest as possible to the hook, which optimises the inter-sector sealing,
- each ring sector comprises, at one of the circumferential ends thereof, at least one seal lip of which the upstream axial end passes through a notch of the deflector and axially bears on a hook of this ring sector, and at the other of the circumferential ends thereof, at least one seal lip of which the upstream axial end passes through a notch of the deflector and bears on a hook of an adjacent ring sector.

The present invention also relates to a turbine engine, comprising at least one sealing module such as described above.

DESCRIPTION OF THE FIGURES

The invention will be better understood and other details, characteristics and advantages of the invention will appear upon reading the following description given as a non-limiting example and in reference to the appended drawings, wherein.

DETAILED DESCRIPTION

Figure 1:
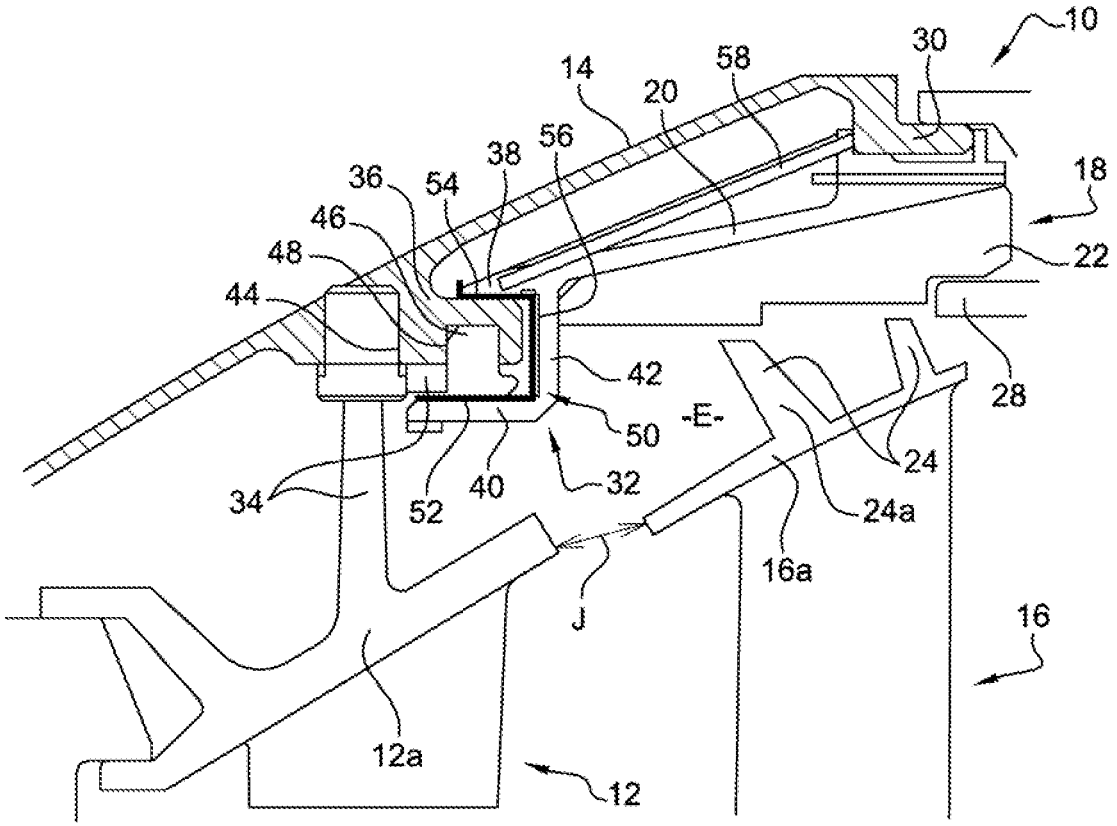
FIG. 1 is an axial, cross-sectional, partial, schematic half-view of a turbine engine turbine.

First, FIG. 1 is referred to, which represents a turbine 10, here low-pressure, of a turbine engine such a turbine engine or an aircraft turboprop, this turbine comprising several stages (only one of which is represented here) each comprising a distributor 12 formed of an annular row of fixed blades carried by a casing 14 of the turbine, and an impeller 16 mounted downstream of the distributor 12 and rotating about an axis (not visible) in a ring 18 fastened to the casing 14.

The ring 18 is sectored and formed of several sectors which are carried circumferentially end-to-end by the casing 14 of the turbine.

Each ring sector 18 comprises a body 20 which extends circumferentially and a coating 22 of abradable material fixed by soldering and/or welding on the radially inner surface of the body 20, this coating 22 being of the honeycomb type and being intended to be used by friction on the outer seal lips 24 of the blades of the impeller 16 to minimise the radial clearances between the impeller and the ring sectors 18. The seal lips 24 are formed protruding over an outer platform **16*a* of the impeller 16, the outer platform 16*a*** being connected to a blade of the impeller.

Each ring sector 18 comprises, at the upstream end thereof, a hook 32 with a C- or U-shaped cross-section which extends circumferentially and of which the opening opens upstream, this hook 32 being axially engaged from downstream on a fastening spoiler 34 oriented towards the downstream of the distributor 12 which extends circumferentially upstream of the ring sectors 18, on the one hand, and on a cylindrical rail 36 of the casing 14 on which is fastened this distributor, on the other hand. The spoiler 34 has a general L-shape and protrudes from a platform 12*a* of the distributor 12, to which are connected at least one blade of the distributor.

The hook 32 of each ring sector 18 comprises two walls 38 and 40 extending circumferentially and upstream, each wall, respectively radially outwards and radially inwards are connected together at the downstream ends thereof by a substantially radial median bottom wall 42, and which extend respectively radially outside and inside the rail 36, the inner wall 40 radially holding the spoiler 34 of the distributor against the rail 36.

Such as illustrated in FIG. 1, the circumferential holding of the distributor 12 is ensured by way of an anti-rotating pin 44 which is carried by the casing 14 and is engaged in a notch of the distributor 12. The axial holding thereof downstream is ensured by an annular split ring 46 which is mounted in an annular groove 48 of the rail 36, which opens radially inwards. In this case, the spoiler 34 of the distributor 12 axially bears downstream on the ring 46 which is held radially in the groove of the casing rail by the inner wall 40, which extends radially inside the ring 46. In a variant, the axial stopping function of the ring 46 can be ensured directly by the casing rail 36.

The downstream ends of the ring sectors 18 are radially clamped on a cylindrical rail 30 of the casing by the distributor located downstream of the ring sectors. The ring sectors 18 radially bear outwards on a radially inward cylindrical face of the rail 30 of the casing, and inwards on a radially outward cylindrical face of a cylindrical edge 28 of the downstream distributor. The downstream ends of the ring sectors 18 are furthermore clamped axially via the lugs on the cylindrical rail 30.

To thermally protect the rail 36, and against the wear, it is also known to use an annular foil 50 which is sectored and comprises an annular row of foil sectors arranged circumferentially end-to-end. It has, in the cross-section, a general C- or U-shape and comprises coaxial annular walls, respectively inner 52 and outer 54, connected together by a median bottom wall 56.

The foil 50 is mounted on the casing rail 36 and on the spoiler 34 of the distributor 12 such that the inner walls 52 of the foil sectors 50 are inserted between the inner walls 40 of the hooks 32 of the ring sectors 18, on the one hand, and the spoiler 34 of the distributor 12 and the annular ring 46, on the other hand, that the outer walls 54 of the foil sectors are inserted between the outer walls 38 of the hooks 32 of the ring sectors and the casing rail 36, and that the bottom walls 56 of the foil sectors are inserted between the bottom walls 42 of the hooks of the ring sectors and the casing rail 36.

The foil sectors 50 are made of sheet metal and make it possible to avoid the direct contacts between the hooks 32 of the ring sectors 18 and the casing rail 36, which makes it possible on the one hand to protect the latter against wear by friction and on the other hand, to thermally protect it from the ring which can be very hot while functioning, due to the proximity thereof with the combustion gases flowing into the turbine duct.

To avoid gas leaks towards the casing 14, it is also known to mount seal lips 58 at the level of the inter-sector circumferential clearances. The longitudinal edges of the circumferential ends of the ring sectors comprise mounting slots for the seal lips 58. The seal lips 58 each have a general extended and flat shape and each comprise a longitudinal edge engaged in a slot of the edge of a ring sector and an opposite longitudinal edge engaged in a slot of the edge facing an adjacent ring sector.

FIG. 1 represents a first sealing technology 18 wherein the body and the hook 32 are formed of one single part.

Figure 2:
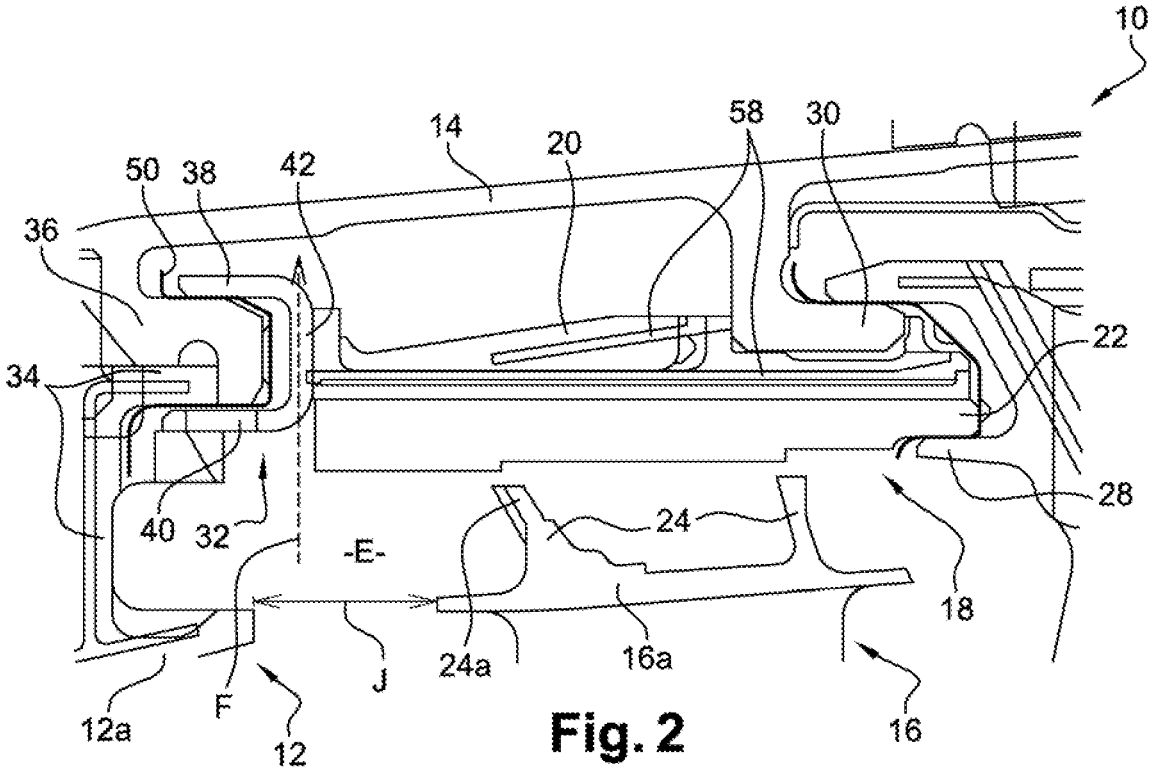
FIG. 2 is an axial, cross-sectional, partial, schematic half-view of another turbine engine turbine.

FIG. 2 represents a second sealing ring technology 18 wherein the body 20 and the hook 32 are formed of assembled parts. The references used in FIG. 2 are the same as those of FIG. 1, insofar as they designate the same elements.

The second technology covers the case where the hook 32 is fixed under the body, just upstream of the coating 22 (as is the case in application FR-A1-3 914 350), as well as the case where the hook 32 is fixed upstream of the body, as is the case in the example represented.

While functioning, combustion gases flow upstream to downstream in the turbine duct, through the blades of the distributors 12 and the module blades of the impellers 16. The outer periphery of each distributor 12 is separated by an axial clearance J of the outer periphery of the adjacent impeller 16, which can be passed through by leak gases. The engagement of the seal lips 24 with the abradable coating 22 limits the passage of these leak gases upstream to downstream between the impeller 16 and the ring 18. The leak gases thus circulate in the annular space E extending radially between the outer platforms 12*a*, 16*a* of the distributor 12 and of the impeller 16, and axially between the downstream spoiler 34 of the distributor 12 and the upstream seal lip 24*a* of the impeller 16.

The strips 58 limit the passage of gases from the space E radially outwards, at the level of the circumferential clearances between the bodies 20 of the ring sectors. However, as can best be seen in FIG. 3, the circumferential clearances are always present between the hooks 32 and gases can pass from the space E radially outwards, in particular between the median bottom walls 42 of the hooks 32 (arrow F).

Figure 3:
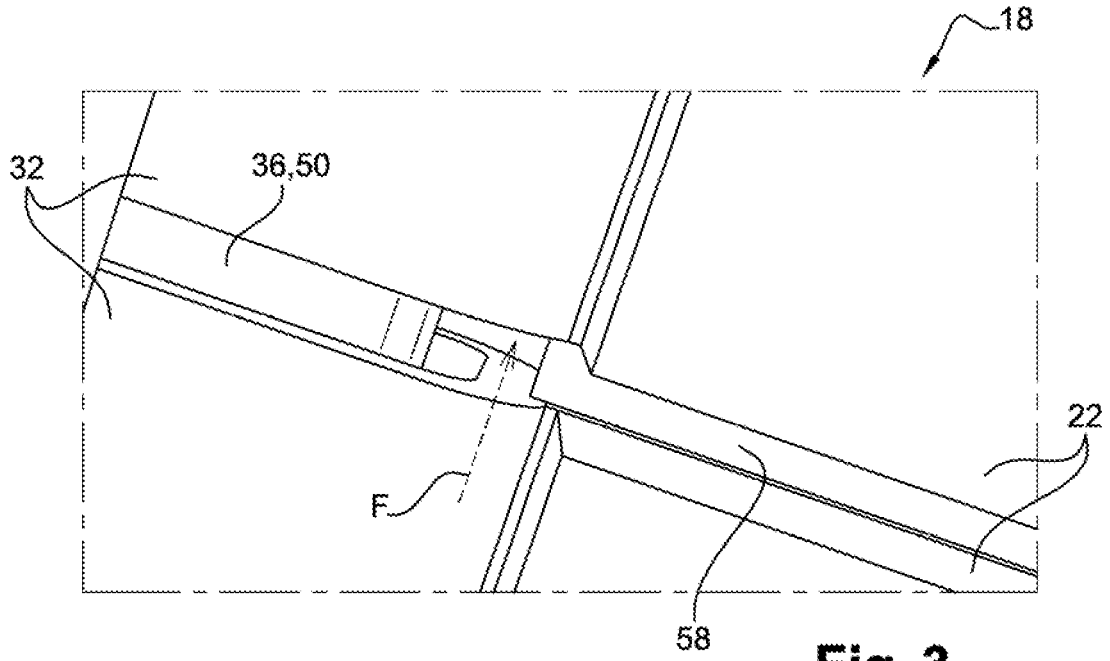
FIG. 3 is a perspective, partial, schematic view, on a larger scale, of a sealing ring of the turbine of FIG. 2.
Figure 4:
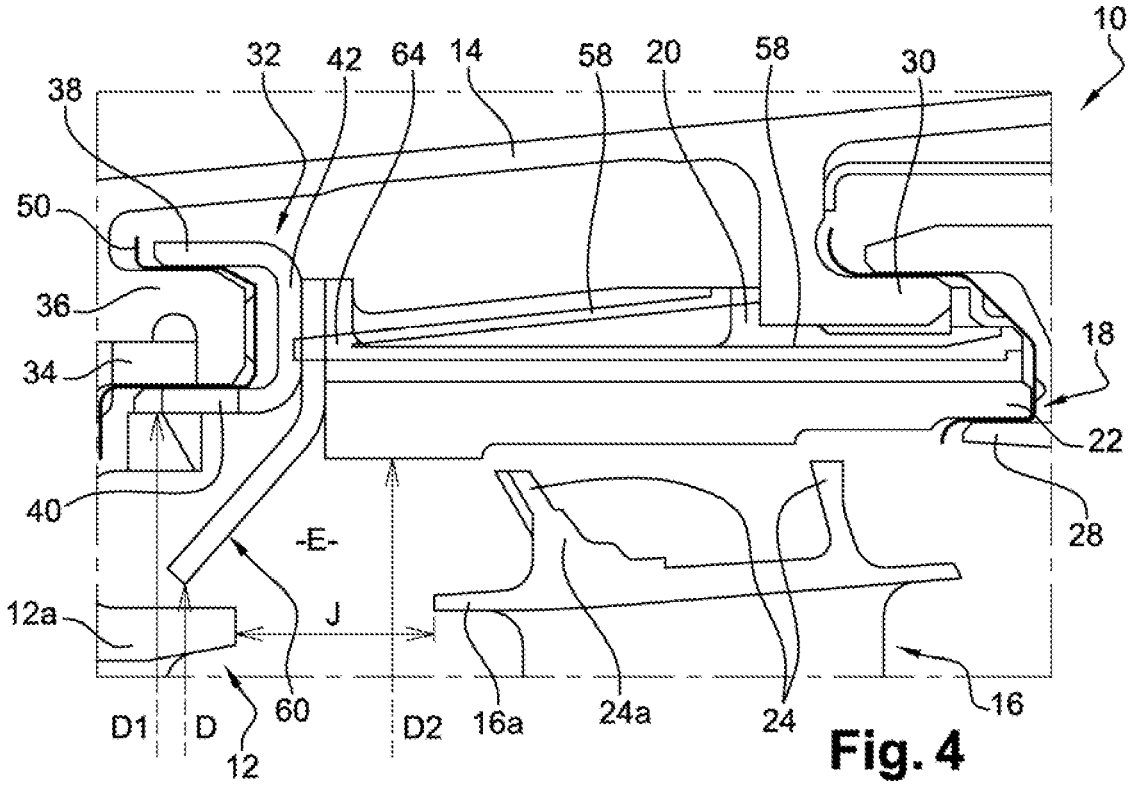
FIG. 4 is an axial, cross-sectional, partial, schematic half-view of a turbine engine module according to the invention.

FIG. 4 and below represent an embodiment of the invention which makes it possible to resolve at least some of these problems. The references used in FIG. 3 are the same as those of the preceding figures insofar as they designate the same elements.

The ring 18 differs from that described above, in particular in that each ring sector further comprises a deflector 60 which is arranged upstream of the coating 22 and which extends radially inwards with respect to the abovementioned axis such that the radially inward end thereof extends around the downstream end of the outer platform 12*a* of the distributor 12. In the example represented, the deflector 60 is formed by an independent part of the hook 32 and of the body 20, and which is inserted axially between the hook 32 located upstream, and the body 20 and the coating 22 located downstream. The deflector 60 can be formed by an annular sheet metal sector.

The deflector 60 here has a general curved orientation and a general V-shape. It thus comprises a radially outward portion 60*a* extending into a plane, substantially perpendicular to the abovementioned axis, and a radially inward portion 60*b* which is truncated.

The portion 60*a* is inserted between the median bottom wall 42 of the hook 32 and the upstream ends of the body 20 and of the coating 22.

The portion 60*b* extends downstream to upstream, radially inwards. The inner periphery thereof defines a diameter D which is less than the smallest inner diameters D1, D2 of the hook 32 and of the coating 22. This inner periphery here surrounds, with a small radial clearance, the end of the outer platform 12*a* of the distributor 12 (FIG. 4).

The deflector 60 has a circumferential extent about the axis which is identical to that of the body 20 and of the coating 22. The circumferential ends of the deflector 60 are substantially aligned axially with those of the body and of the coating 22, as can be seen in FIG. 5.

Figure 5:
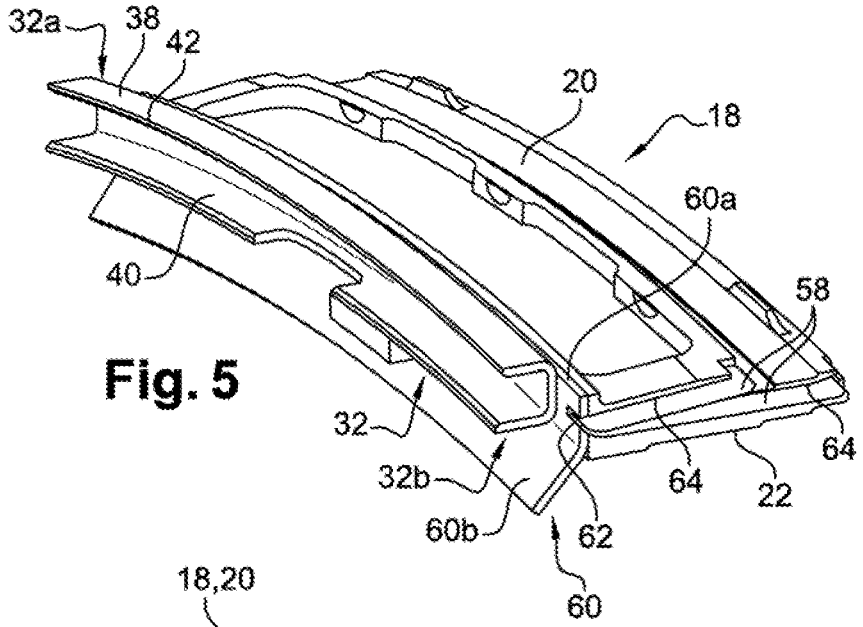
FIG. 5 is a perspective, schematic view of a sealing ring sector of the module of FIG. 4.

FIG. 5 makes it possible also to see that the deflector 60 comprises, at the circumferential ends thereof, notches 62 aligned axially with the slots 64 for housing inter-sector sealing strips 58. These notches 62 are designed to be able to be passed through by the strips 58. Each notch 62 has a height (or radial dimension) at least equal to the height (or radial dimension of the slots 64 for housing the strips), and a width (or circumferential dimension) at least equal to the circumferential dimension between the bottoms of the two slots 64 facing the housing for the strips.

It will be noted in the drawings, that the longitudinal edge of each circumferential end of a ring sector can comprise two slots 64 for housing two strips 58, which have different lengths and extend on top of one another in the radial direction. The upstream ends of the slots 64 are joined at the upstream end of each edge and both communicate with the notch 62, even if the two strips 58 of each edge are likely to pass through the notch 62 (FIGS. 4 and 5). In a variant, the edge of each circumferential end of a ring sector could carry one single strip 58.

Each hook 32 has a circumferential extent identical to that of the deflector 60, and the circumferential ends of the hook 32 are offset in the circumferential direction of the circumferential ends of the deflector (FIG. 5). Each hook 32 thus comprises a circumferential end portion 32*a* which protrudes with respect to the circumferential ends of the other parts of the ring sector, and another circumferential end portion 32*b* which is removed with respect to the circumferential ends of the other parts of the ring sector (FIG. 5).

Figure 6:
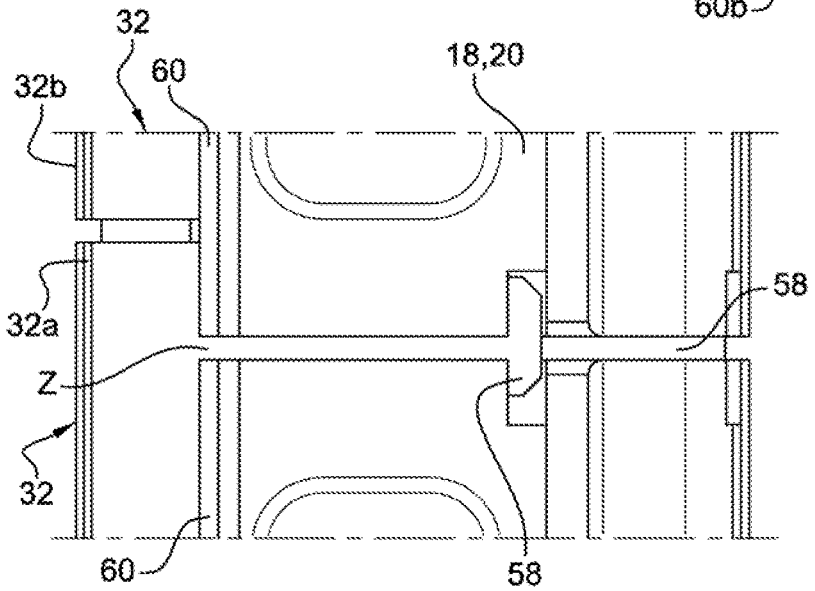
FIGS. 6 and 7 are perspective, schematic views, on a larger scale, of the inter-sector clearances of the sealing ring of the module of FIG. 4.

During the mounting of the ring 18 on the casing, it is understood therefore that the ring sectors will be circumferentially interlocked together (FIG. 6).

Figure 7:
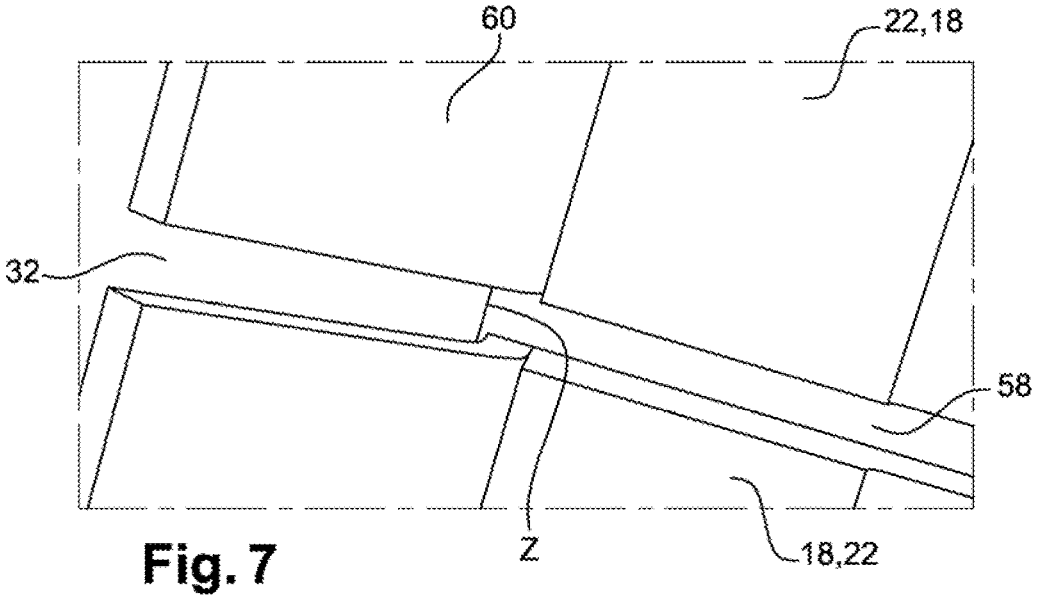

At the level of the circumferential end of each ring sector comprising the protruding end portion 32*a*, the strips 58 axially bear on this end portion (the support zone Z can be seen in FIGS. 6 and 7). At the level of the circumferential end of each ring sector comprising the removed end portion 32*b*, the strips 58 bear axially not on this end portion 32*b*, but on the end portion 32*a* of the adjacent ring sector.

As can be seen in FIG. 4, the deflector 60 extends into the space E located between the hook 32 and the end 12 of the outer platform 12*a* of the distributor and splits it into two respectively upstream and downstream portions. The shape thereof imposes on the leak gases passing through the clearance J of flowing downstream in the direction of the labyrinth seal defined by the seal lips 24. There is therefore less risk of leak gas circulation at the level of the hooks 32 of the ring sectors. The inter-sector clearances at the level of these hooks are moreover sealed due to the circumferential offset between the hooks 32 and the deflectors 60. The invention thus makes it possible to effectively protect the casing 14 and improve the lifespan thereof and also avoid losses from the duct to the casing, which improves the efficiency of the turbine engine.

The invention claimed is:

1. A turbine engine turbine sealing module, for an aircraft, the sealing module extending about an axis and comprising a distributor fixed to a casing, the distributor having at least one blade connected to an outer platform, the outer platform comprising a spoiler for fixing to the casing, the sealing module further comprising an impeller mounted rotating inside the casing and surrounded by a sealing ring fastened to the casing, the sealing ring being sectored and comprising an annular row of ring sectors arranged such that the circumferential end edges of two adjacent sectors are facing each other, each ring sector comprising a body carrying an abradable coating configured to engage with at least one seal lip carried by the impeller and a hook which extends circumferentially by being located upstream of said abradable coating and which is configured to engage with a fastening rail of the casing, the hook having, in a cross-section, a general C-shape having an opening, which is axially oriented upstream and intended to receive said rail, wherein each ring sector further comprises a deflector which is arranged upstream of said coating and which extends radially inwards and upstream with respect to the axis, such that the radially inward end thereof extends around a downstream end of the outer platform of the distributor, and wherein each hook has a circumferential extent identical to that of said deflector, and each circumferential end of said hook is offset in the circumferential direction of each circumferential end of said deflector, wherein said body comprises, at its circumferential ends thereof, slots for housing inter-sector sealing strips, and said defector comprises, at its circumferential ends thereof, notches aligned axially with these slots such that the upstream axial ends of at least some of said sealing strips enter into these notches.

2. The sealing module according to claim 1, wherein said deflector comprises an annular sheet metal sector inserted axially between the hook and the coating and/or body.

3. The sealing module according to claim 2, wherein the sheet metal sector has, in the cross-section, a general V-shape, of which a radially outer portion extends radially, and of which a radially inner portion is truncated and extends, downstream to upstream, radially inwards.

4. The sealing module according to claim 3, wherein the hook comprises a median bottom wall which connects two respectively inner and outer walls which extend circumferentially, the radially outer portion of the sheet metal sector being inserted axially between the bottom wall of the hook, and the coating and/or the body.

5. The sealing module according to claim 1, wherein each deflector has a circumferential extent identical to that of said body and of said coating, and the circumferential ends of said deflector are substantially aligned axially with those of said body and of said coating.

6. The sealing module according to claim 1, wherein each ring sector comprises, at one of the circumferential ends thereof, at least one sealing strip of which the axial end passes through a notch of the deflector and axially bears on a hook of this ring sector, and to the other of the circumferential ends thereof, at least one sealing strip of which the upstream axial end passes through a notch of the deflector and axially bears on a hook of an adjacent ring sector.

7. A turbine engine, comprising at least one sealing module according to claim 1.

* * * * *